United States Patent [19]

Müller

[11] 4,235,434

[45] Nov. 25, 1980

[54] APPARATUS FOR DIVERTING GROUPS OF PAPER SHEETS OR THE LIKE TO PROCESSING MACHINE

[75] Inventor: Hans Müller, Zofingen, Switzerland

[73] Assignee: Grapha-Holding AG, Hergiswil, Switzerland

[21] Appl. No.: 908,546

[22] Filed: May 22, 1978

[30] Foreign Application Priority Data

Jun. 1, 1977 [CH] Switzerland ..... 6700/77

[51] Int. Cl.[3] ..... B65H 29/64

[52] U.S. Cl. ..... 271/280; 271/305

[58] Field of Search ..... 271/64, 172, 280, 305, 271/64

[56] References Cited

U.S. PATENT DOCUMENTS

| | | | |
|---|---|---|---|
| 2,164,436 | 7/1939 | Waters | 271/64 X |
| 2,563,492 | 8/1951 | Turrall | 271/64 |
| 2,856,182 | 10/1958 | Cantrell | 271/64 X |
| 3,037,625 | 6/1962 | Azari | 271/64 |
| 3,358,831 | 12/1967 | Cothrell | 271/64 X |

*Primary Examiner*—Richard A. Schacher

*Attorney, Agent, or Firm*—Peter K. Kontler

[57] ABSTRACT

Apparatus is provided for diverting groups of sheets to one or more processing machines which are adjacent to an elongated path defined by a transporting system consisting of a series of conveyors separated from each other by pivotable switches. Each processing machine can receive sheets from the transporting system in response to pivoting of the adjacent switch to a sheet-diverting position, and the switch which precedes such switch is pivotable to a position in which it diverts sheets onto an auxiliary conveyor which can be started to deliver sheets directly to the respective processing machine. The discharge end of the transporting system delivers surplus sheets to a stacker, and a switch which is located ahead of the foremost auxiliary conveyor can be caused to divert sheets into a row forming machine.

14 Claims, 5 Drawing Figures

APPARATUS FOR DIVERTING GROUPS OF PAPER SHEETS OR THE LIKE TO PROCESSING MACHINE

BACKGROUND OF THE INVENTION

The present invention relates to apparatus for supplying paper sheets or the like to one or more processing or consuming machines, and more particularly to improvements in apparatus for diverting groups of partially overlapping sheets to one or more machines which process discrete sheets, sections of or entire newspapers, brochures or the like.

It is already known to utilize a transporting system which receives sheets from a printing press or another suitable source and advances the sheets in the form of a scalloped stream to one or more processing or consuming machines, such as gathering machines and the like. As a rule, the transporting system includes switches which can be actuated to divert portions of the stream into a consuming machine whenever the need arises, e.g., when the magazine of a particular consuming machine is empty or the supply of sheets therein is about to be depleted. The transporting system is normally associated with a group forming device which breaks up a continuous stream of partly overlapping sheets into a file of discrete groups each of which contains a predetermined number of sheets. The width of clearances or gaps between neighboring groups of the file suffices to insure that the diversion of an entire preceding group from the main path can be completed and the switch returned to normal position before the foremost sheet of the next-following group reaches the diverting station.

In the event of malfunction of a consuming or processing machine (e.g., a machine which assembles different types of sheets into signatures or the like and delivers signatures to a collating machine), the group of sheets which was destined to be admitted into the defective or intentionally arrested consuming machine continues to advance along the main path which is defined by the transporting system and enters a stacker (also called overflow) which is located at the discharge end of the transporting system. In most instances, the cause of malfunction is eliminated within a short interval of time. However, and since each malfunction of a consuming machine involves the advancement of at least one complete group of partially overlapping sheets into the stacker, the latter is likely to rapidly accumulate a substantial supply of sheets, i.e., a high percentage of sheets is or is likely to be withdrawn from immediate processing.

Another drawback of presently known transporting systems is that, when a conventional system serves to deliver groups of sheets to several processing or consuming machines which are disposed one after the other, as considered in the direction of transport of groups of sheets, a consuming machine which is remote from the source of sheets cannot immediately receive one or more groups of sheets when the need for replenishment of the supply of sheets in such consuming machine arises. This will be readily appreciated by bearing in mind that the admission of sheets to a consuming machine invariably involves the diversion of at least one complete group of sheets from the main path which is defined by the transporting system. Thus, and assuming that a preceding consuming machine receives one or more groups of sheets, the stream of sheets in the main path exhibits one or more wide gaps which develop as a result of removal of one or more complete groups; therefore, a remote consuming machine is likely to process the entire supply of sheets in its magazine before a group of sheets which follows a wide gap in the main path reaches that switch which must be actuated to divert one or more groups into the magazine of the remote consuming machine. Furthermore, a switch cannot be moved while a group of sheets advances therealong toward the next consuming machine or to the stacker. This further aggravates the situation because the just mentioned group must advance beyond the switch and the latter moves to a different position in order to divert one or more groups into the remote consuming machine with a corresponding delay. The delay is further increased if the group which has advanced beyond the just mentioned switch is followed by a relatively wide gap resulting from diversion of one or more groups into the preceding consuming machine or machines. It happens quite frequently that a remote consuming machine will use up the entire supply of sheets in its magazine before the transporting system delivers a fresh supply (one or more groups) of sheets.

OBJECTS AND SUMMARY OF THE INVENTION

An object of the invention is to provide an apparatus which can direct groups of paper sheets to one or more consuming or processing machines practically without any or with negligible delay.

Another object of the invention is to provide an apparatus which is constructed and assembled in such a way that a supply of sheets is held in a position of readiness for delivery to a consuming machine whenever the need arises.

A further object of the invention is to provide an apparatus which can automatically store the surplus of sheets in the event of malfunction or intentional stoppage of one or more consuming machines.

An additional object of the invention is to provide an apparatus which can insure delivery of sheets to one or more consuming machines regardless of whether the combined requirements of the consuming machines exceed, equal or do not match the output of the machine or machines which furnish the sheets for further processing.

Another object of the invention is to provide an apparatus which can satisfy the requirements of high-speed processing or consuming machines and whose operation can be automated to such an extent that it requires a minimum of supervision.

An additional object of the invention is to provide the apparatus with facilities for temporary or longer-lasting storage of groups of sheets.

A further object of the invention is to provide the apparatus with novel means for diverting sheets from a main path into one or more additional paths in such sequence that each consuming machine can receive a supply of sheets on short notice and in quantities which suffice to reduce the need for frequent diversion of sheets to selected consuming machine or machines.

Another object of the invention is to provide an apparatus which can simultaneously satisfy the requirements of two or more consuming or processing machines.

An ancillary object of the invention is to provide the apparatus with facilities for temporary and/or longer-lasting storage of groups of sheets whose capacity suffices to allow for storage of the surplus even if the output of the machine or machines which supply sheets to the apparatus substantially exceeds the momentary or maximum requirements of one, more or all consuming or processing machines.

The invention is embodied in an apparatus for intermittently delivering sheets to at least one consuming machine, e.g., to a variable-capacity gathering machine. The apparatus comprises transporting means defining a predetermined path for advancement of successive sheets (particularly a series of groups of partly overlapping sheets) and including a preceding section and a next following section each having a sheet-discharging end (each section of the transporting means may constitute one or more discrete conveyors which advance sheets in a direction toward the discharge end of the transporting means), a first switch provided at the sheet-discharging end of the next-following section, a motor or analogous actuating means for moving the switch to and from a position in which the switch diverts sheets from the path into the consuming machine (e.g., onto a feeding conveyor which delivers sheets to the magazine of the consuming machine), an auxiliary conveyor or analogous means for temporary storage of sheets adjacent to the consuming machine, a second switch mounted between the preceding and the next-following sections of the transporting means, and a motor or analogous actuating means for moving the second switch between first and second positions in which the second switch respectively guides sheets from the preceding toward or into the next-following section and diverts sheets leaving the preceding section into the storage means. The apparatus preferably further comprises a main prime mover (e.g., an electric motor) and clutch means which is engageable to drive the auxiliary conveyor in a direction to transfer sheets from the auxiliary conveyor into the consuming machine.

The apparatus can comprise additional sections, switches and auxiliary conveyor means for delivery of sheets to a second consuming machine which is mounted adjacent to the path upstream or downstream of the first mentioned consuming machine. A stacker or analogous receiving means for surplus sheets can be provided at the discharge end of the transporting means and/or a row forming machine or analogous means for reception of surplus sheets can be provided ahead of the foremost consuming machine.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
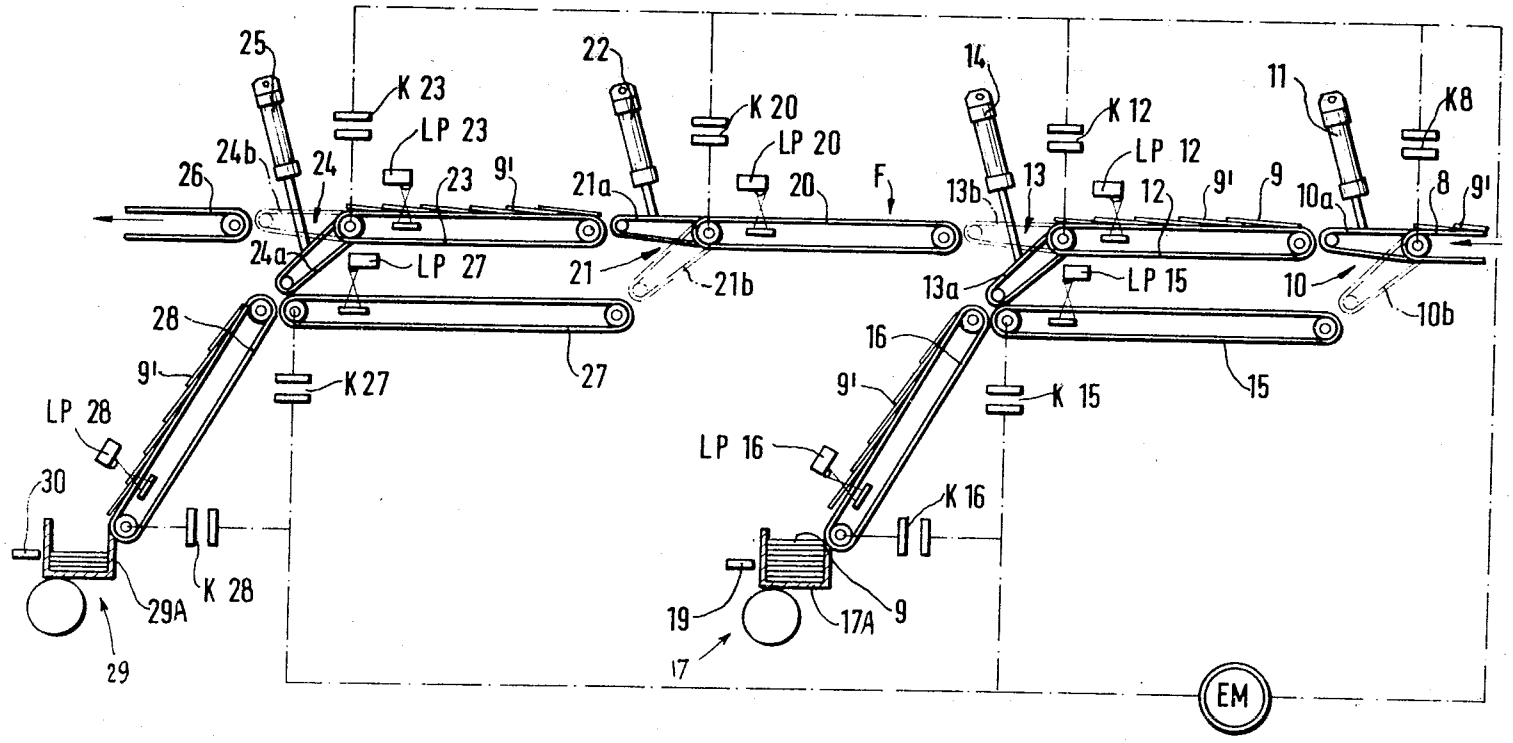
FIG. 1 is a schematic side elevational view of the central portion of an apparatus which embodies the invention.
Figure 3:
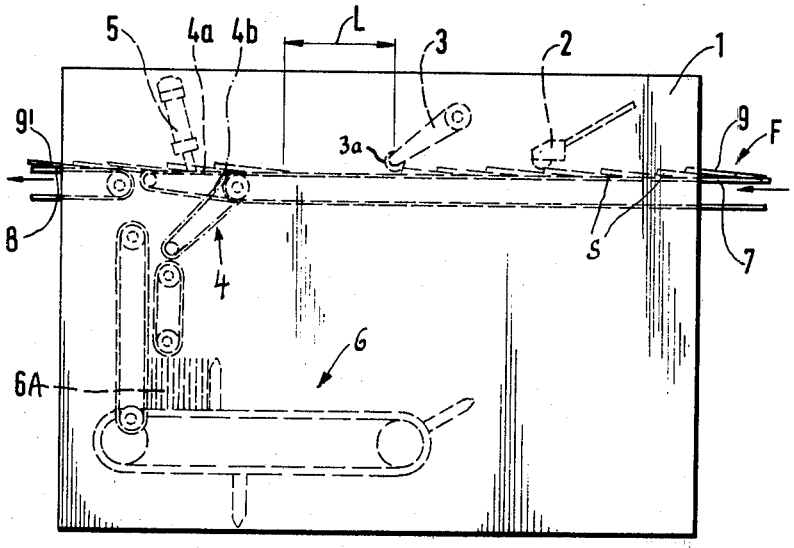
FIG. 3 illustrates the right-hand end portion of the apparatus.
Figure 2:
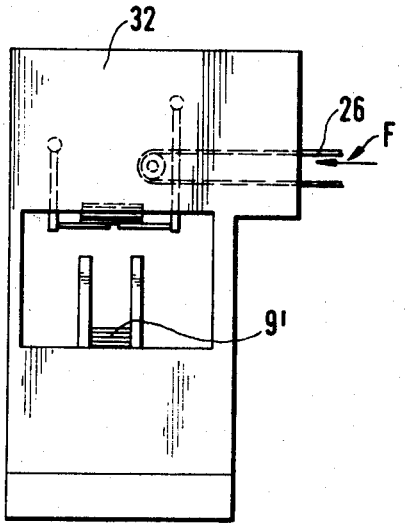
FIG. 2 illustrates the left-hand end portion of the apparatus.

Referring first to FIGS. 1–3, there is shown a transporting system F which is mounted in or on a frame or housing 1 and receives a continuous stream 9 of sheets S (see FIG. 3) from a suitable source, e.g., from a rotary printing press for newspapers or the like. As a rule, the press is followed by a machine which folds successive printed sheets and delivers the folded sheets to the first or foremost conveyor 7 of the transporting system F in such a way that the fold is located at the leading end of each folded sheet and the leader of each next-following sheet overlies the trailing portion of the preceding sheet in the stream 9. The conveyor 7 constitutes the first section or component of the transporting system F which further includes conveyors or sections 8, 12, 20, 23 and 26 defining an elongated horizontal main path for the transport of sheets to any one of several consuming machines 17, 29 or to a stacker 32 shown in FIG. 2 at the discharge end of the system F. The consuming machine 17 can receive sheets from the conveyor 8 or 12, the consuming machine 29 can receive sheets from the conveyor 20 or 23, and the stacker 32 receives all surplus sheets which reach and are advanced by the conveyor 26 of the system F, i.e., all sheets which cannot be processed by the machine 17 and/or 29 due to a malfunction, intentional stoppage or for other reasons.

A first diverting device or switch 4 is disposed between the conveyors 7 and 8 (see FIG. 3). The actuating means for moving the switch 4 between the positions **4*a* and 4*b* comprises a motor here shown as a double-acting fluid operated cylinder and piston unit 5. When the switch 4 assumes the position 4*a*, it enables successive sheets to advance from the sheet-discharging end of the conveyor 7 onto the upper reach of the conveyor 8 (each conveyor of the transporting system F preferably includes one or more endless flexible elements in the form of belts or chains whose upper reaches define the aforementioned main path for the advancement of sheets to the consuming machine 17, to the consuming machine 29 or to the stacker 32). When the switch 4 is moved to the position 4*b*, it diverts the sheets into a row forming machine 6, e.g., an apparatus of the type disclosed in the commonly owned copending application Ser. No. 751,738 filed on Dec. 17, 1976 by Hans Müller. The rows 6A which are assembled in the machine 6 can be tied to form bales which are used in the consuming machine 17 and/or 29, e.g., in the event of malfunction of the transporting system F or stoppage of the machine which supplies sheets to the conveyor 7**.

The sheets S of the stream 9 on the conveyor 7 are scanned by the signal generating sensor 2 of a conventional counter which controls the operation of a group forming device 3 adjacent to the main path portion on the conveyor 7 downstream of the sensor 2. The device 3 comprises one or more braking rollers or wheels **3*a* which descend and engage the oncoming sheet S at intervals determined by the counter which includes the sensor 2. In this way, the device 3 divides the continuous stream 9 into a single file of discrete groups 9' or shorter streams with a clearance L between each pair of neighboring groups 9' as well as between the last group 9' of the stream 9**.

The stacker 32 is optional if the apparatus includes the aforementioned row forming machine 6 because the machine 6 is capable (or can be designed to be capable) of accepting all such sheets which cannot be processed in the consuming machine 17 and/or 29. As mentioned above, the consuming machines 17 and 29 can deliver sheets to or may constitute gathering machines, collating machines or other types of processing machines. A suitable gathering machine is disclosed in the commonly owned U.S. Pat. No. 4,085,927 granted Apr. 25, 1978 to Hans Müller, and a suitable collating or inserting machine is disclosed in the commonly owned copending application Ser. No. 764,640 filed Feb. 1, 1977 by Hans Müller.

Additional diverting devices or switches 10, 13, 21 and 24 are respectively disposed between the conveyors 8, 12 and 12, 20 and 20, 23 and 23, 26 of the transporting system F. The actuating means for moving the switches 10, 13, 21 and 24 are respectively shown at 11, 14, 22 and 25, and each of these actuating means is preferably analogous to or identical with the aforedescribed actuating means 5 for moving the switch 4. The actuating means 11 can move the switch 10 between a position 10*a* in which the switch enables successive groups 9′ to advance from the sheet-discharging end of the preceding conveyor 8 onto the upper reach of the next-following conveyor 12, and a position 10*b* in which the switch 10 diverts one or more groups 9′ onto an auxiliary conveyor 15 which constitutes a means for temporarily storing one or more groups 9′ (depending on the length of the upper reach of its belt). The sheet-discharging end of the auxiliary conveyor 15 is adjacent to the receiving end of a feeding conveyor 16 which serves to deliver groups 9′ of sheets to the magazine 17A of the consuming machine 17. The upper end of the feeding conveyor 16 can receive groups 9′ directly from the main path when the actuating means 14 moves the switch 13 to the position 13*a*. In the position 13*b*, the switch 13 allows successive groups 9′ to advance from the sheet-discharging end of the conveyor 12 onto the upper reach of the conveyor 20. The conveyor 16 can be said to form part of the consuming machine 17.

The actuating means 22 can move the switch 21 to the position 21*a* in which successive groups 9′ can advance from the sheet-discharging end of the conveyor 20 onto the upper reach of the conveyor 23 or to the position 21*b* in which the switch 21 diverts the oncoming group or groups onto a second auxiliary conveyor 27 constituting a means for temporarily storing one or more groups 9′ (depending on the length of the upper reach of the conveyor 27) adjacent to the consuming machine 29. The discharge end of the auxiliary conveyor 27 is adjacent to the upper or receiving end of a feeding conveyor 28 which delivers groups 9′ to the magazine 29A of the consuming machine 29. The feeding conveyor 28 of the machine 29 can receive groups 9′ directly from the conveyor 23 when the actuating means 25 maintains the switch 24 in the position 24*a*. When the switch 24 is moved to the position 24*b*, the groups 9′ are free to advance from the sheet-discharging end of the conveyor 23 onto the upper reach of the conveyor 26 and thence into the stacker 32.

The length of the auxiliary conveyor 15 preferably equals the length of the auxiliary conveyor 27, i.e., each of these conveyors can accommodate the same number (one or more) of the groups 9′. The paths which are defined by the auxiliary conveyors 15, 27 are preferably parallel to the main path, i.e., to the path which is defined by the conveyors or sections of the transporting system F.

The magazines 17A and 29A are respectively associated with level monitoring detectors 19, 30 each of which can transmit signals denoting that the supply of sheets S in the respective magazine has been depleted to a predetermined value which warrants the admission of one or more groups 9′. Each of the detectors 19, 30 may constitute a photocell.

Each conveyor of the transporting system F can support one or more groups 9′. Furthermore, certain conveyors (see the conveyor 7) of the system F can be longer than the other conveyor or conveyors.

The conveyors of the apparatus which is shown in FIGS. 1–3 receive motion from a main prime mover EM (e.g., a variable-speed electric motor) which drives the input elements of the clutches K8 (conveyor 8), K12 (conveyor 12), K20 (conveyor 20), K23 (conveyor 23), K15 (conveyor 15), K16 (conveyor 16), K27 (conveyor 27) and K28 (conveyor 28). Detectors LP12, LP20, LP23, LP15, LP27, LP16 and LP28 (e.g., photocells) are provided to transmit signals which denote the presence or absence of groups 9′ on the upper reaches of the respective conveyors 12, 20, 23, 15, 27, 16 and 28. The conveyor 26 can be driven continuously or intermittently, e.g., together with the preceding conveyor 23.

Figure 4:
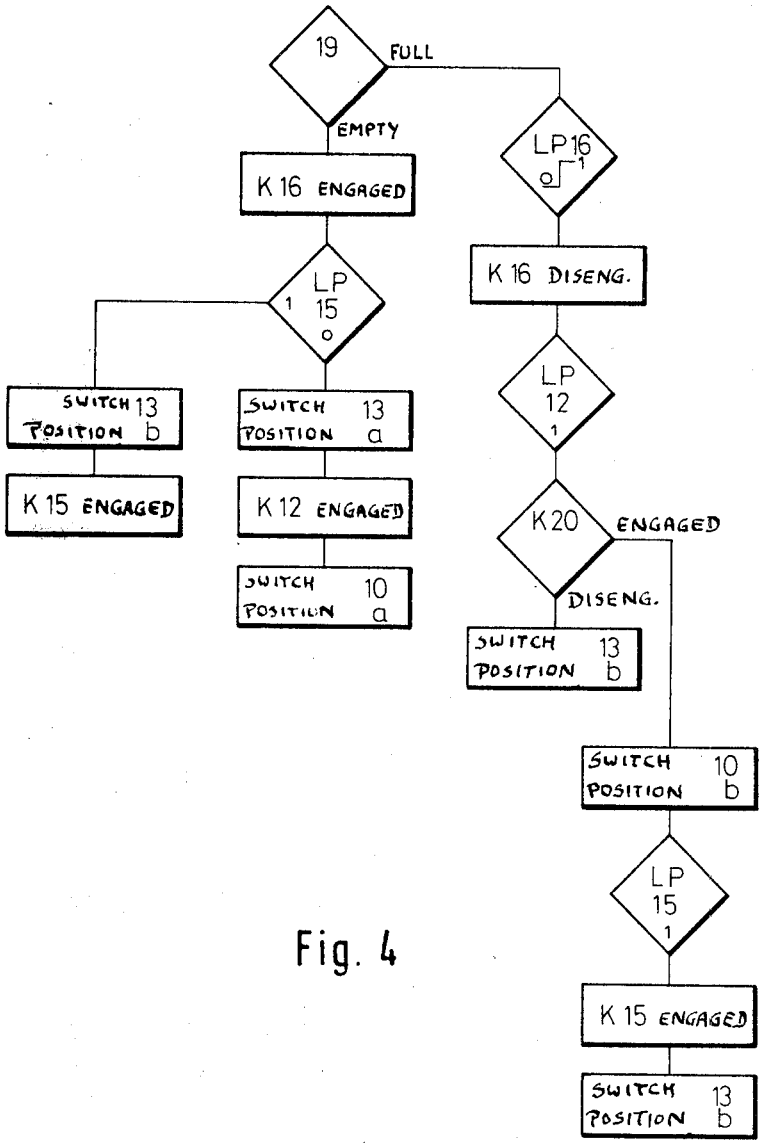
FIG. 4 is a diagram showing certain stages of operation of the apparatus.
Figure 5:
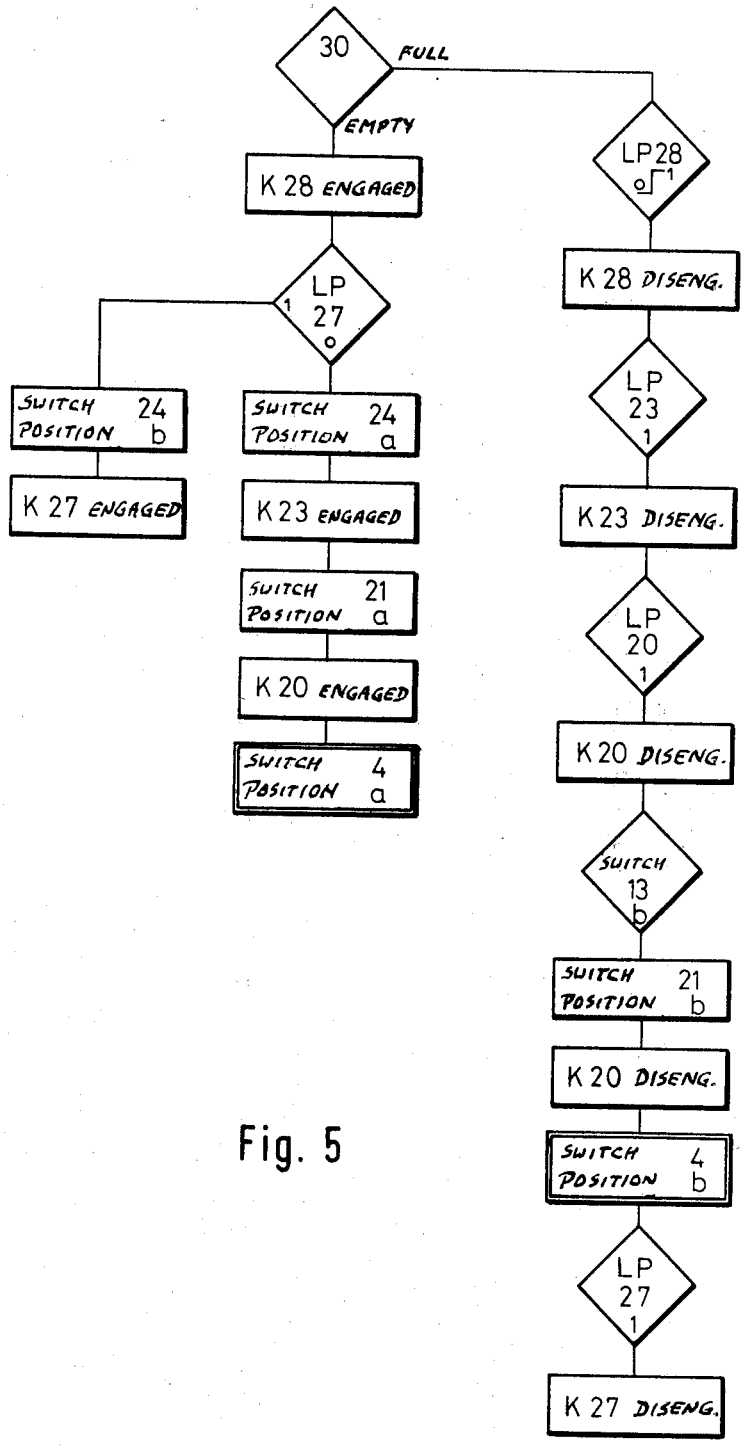
FIG. 5 is a similar diagram showing certain other stages of operation of the apparatus.

The operation of the apparatus will now be described with reference to FIGS. 1–3 as well as with reference to the diagrams of FIGS. 4 and 5.

When the level detector 19 detects that the supply of sheets S in the magazine 17A of the first consuming machine 19 is depleted or about to be depleted, its lower output (FIG. 4) transmits a signal which results in engagement of the clutch K16 to set the feeding conveyor 16 in motion. The upper reach of the conveyor 16 supports a group 9′, and such group is introduced into the magazine 17A. If the detector LP15 indicates that the auxiliary conveyor 15 supports a portion of a group 9′ (this would be attributable to a previous malfunction of the consuming machine 17), its output "1" (FIG. 4) transmits a signal which causes the motor 14 to move the switch 13 to the position 13*b* and the clutch K15 is engaged (see FIG. 4) to set the auxiliary conveyor 15 in motion. This results in the transfer of incomplete group 9′ from the sheet-discharging end of the auxiliary conveyor 15 onto the conveyor 16. If the output "0" of the detector LP15 transmits a signal which indicates that the auxiliary conveyor 15 does not store any sheets, the motor 14 causes the switch 13 to move to the position 13*a* and the clutch K12 is engaged so that the switch 13 permits the transfer of a group 9′ from the conveyor 12 onto the feeding conveyor 16. At the same time, the motor 11 moves the switch 10 to the position 10*a* so that the preceding conveyor 8 delivers a group 9′ to the next-following conveyor 12 of the transporting system F. When the level detector 19 (namely, the right-hand output, as viewed in FIG. 4) and the detector LP16 transmit signals denoting that the magazine 17A is filled and the feeding conveyor 16 supports a group 9′, the clutch K16 is disengaged to bring the feeding conveyor 16 to a standstill.

If the detector LP12 indicates the presence of a group 9′ on the upper reach of the conveyor 12 (as a result of movement of the switch 10 to the position 10*a* and the ensuing transfer of a group 9′ from the preceding conveyor 8 onto the next-following conveyor 12 or because the feeding conveyor 16 received a complete or partial group 9′ from the auxiliary conveyor 15), the signal at the output "1" of the detector LP12 (FIG. 4) causes engagement of the clutch K20 as soon as the level detector 30 for the magazine 29A (FIG. 5, top) indicates that the latter is empty or nearly empty. The clutch K20 is disengaged in the event of malfunction of the consuming machine 29 or when the magazine 29A still contains an adequate supply of sheets S while each of the conveyors 28, 23 and 20 supports at least one group 9'.

If the signal at the lower output of the level detector 30 (FIG. 5) indicates the need for admission of sheets into the magazine 29A, the clutch K20 is engaged and the switch 13 is moved to the position 13*b* (see FIG. 4) to enable the oncoming groups 9' to advance from the conveyor 12 toward the switch 24. If the right-hand output of the detector 30 transmits a signal (no sheets needed), while the conveyors 28, 20, 23 carry groups 9', the clutch K20 is disengaged and the conveyor 20 is thereby arrested. In such instance, the switch 10 is moved to the position 10*b* (see FIG. 4), i.e., the group 9' which is supported by the preceding conveyor 8 is transferred onto the auxiliary conveyor 15. The clutch K15 is disengaged when the detector LP15 (FIG. 4) signals the detection of the leading end of a group 9' on the conveyor 15. The switch 13 is then returned to the position 13*b*. This is also shown in FIG. 4.

When the level detector 30 indicates that the magazine 29A is empty or about to become empty, the clutch K28 is engaged (see FIG. 5) and the group 9' on the feeding conveyor 28 is transferred into the magazine 29A. The feeding conveyor 28 thereupon receives a fresh group 9' in the following way: If the detector LP27 indicates the presence of a group 9' on the auxiliary conveyor 27, its output "1" (see FIG. 5) transmits a signal whereby the switch 24 is pivoted to the position 24*b* and the clutch K27 is engaged to drive the auxiliary conveyor 27 which delivers the group 9' onto the feeding conveyor 28. If the detector LP27 detects the absence of a group 9' on the auxiliary conveyor 27, its output "0" (FIG. 5) transmits a signal whereby the switch 24 is pivoted to the position 24*a* and the clutch K23 is engaged so that the conveyor 23 of the transporting system F delivers a group 9' onto the feeding conveyor 28. At the same time, or immediately thereafter, the switch 21 is pivoted to the position 21*a* (FIG. 5) and the clutch K20 is engaged to start the conveyor 20. Also, the switch 4 is pivoted to the position 4*a* (FIG. 5) so that the conveyor 23 can receive a fresh group 9' via conveyors 8, 12, 20.

When the signal at the right-hand output of the level detector 30 (FIG. 5) indicates that the magazine 29A is adequately filled and the detector LP28 indicates that a group 9' is supported by the upper reach of the feeding conveyor 28, the clutch K28 is disengaged. If, at the same time, the detector LP23 signals the presence of a group 9' on the conveyor 23, i.e., its output "1" (FIG. 5) transmits a signal whereby the clutch K23 is disengaged to arrest the respective conveyor.

If the detector LP20 indicates the presence of a group 9' on the upper reach of the conveyor 20, its output "1" (see FIG. 5) transmits a signal and the clutch K20 is disengaged. If, at such time, the switch 13 assumes the position 13*b* and the detector LP27 indicates that the upper reach of the auxiliary conveyor 27 is unoccupied, the switch 21 is pivoted to the position 21*b* and the clutches K20 and K27 are engaged in order to effect the transfer of the group 9' from the preceding conveyor 20 onto the auxiliary conveyor 27. At the same time, the switch 4 is moved to the position 4*b* (FIG. 5) and, when the detector LP27 indicates the arrival of the leader of a group 9', its output "1" transmits a signal and the clutch K27 is disengaged to arrest the conveyor 27.

The switch 4 is moved to position 4*b* while the conveyor 20 transfers a group 9' onto the auxiliary conveyor 27 only if, at such time, the level detector 19 of the magazine 17A does not transmit a signal indicating that the supply of sheets S in the magazine 17A must be replenished. Prior to moving the switch 4 to the position 4*b*, the switch 10 can be moved to the position 10*b* if the auxiliary conveyor 15 is unoccupied. When the control system including the various detectors ascertains that the auxiliary conveyor 15 is also occupied, the switch 4 is caused to move to the position 4*b* to admit the oncoming groups 9' into the row forming machine 6.

If the consuming machine 17 becomes defective when the auxiliary conveyor 27 is occupied, the clutch K27 remains disengaged and the switch 4 is immediately pivoted to the position 4*b* unless one or more groups 9' can be transferred onto the auxiliary conveyor 27. If not, the clutch K27 remains disengaged and the switch 4 assumes the position 4*b* to divert the groups 9' into the row forming machine 6. Thus, groups 9' are diverted into the machine 6 only when there is no room on the conveyors of the transporting system F, on the auxiliary conveyors 15, 27 and/or on the feeding conveyors 16, 28. However, the filling of auxiliary conveyor 27 and/or 15 prior to diversion of groups 9' into the machine 6 is optional. As mentioned above, the rows which are accumulated in the machine 6 are or can be transferred into the consuming machine 17 and/or 29 at a later time. Apparatus which can effect such transfer is disclosed in commonly owned U.S. Pat. No. 4,052,052 granted Oct. 4, 1977 to Müller.

If the auxiliary conveyor 15 and/or 27 is occupied in the event of malfunction of the consuming machine 17 and/or 29, the switch 4 can remain in the position 4*a* and the switch 24 can be pivoted to the position 24*b* so that the surplus of groups 9' is directed into the stacker 32.

If the requirements of the consuming machines 17 and 29 exceed the output of the source which delivers sheets S to the transporting system F (or if the consuming machines can be adjusted so that their capacity exceeds the capacity of the source of sheets), the consuming machines receive the groups 9' which are temporarily stored on the auxiliary conveyors 15, 27 so that these conveyors normally remain unoccupied and are ready to receive groups 9' in the event of short-lasting malfunction of the one and/or the other consuming machine.

On the other hand, if the requirements of the consuming machines 17, 29 do not match the output of the source which supplies sheets S to the transporting system F, the conveyors 15 and 27 permanently support spare groups 9'. This is desirable and advantageous because the length of intervals for transfer of groups 9' onto the feeding conveyors 16 and 28 is reduced to a minimum, i.e., the feeding conveyors 16, 28 can receive groups 9' from the adjacent auxiliary conveyors 15, 27 regardless of whether or not the nearest conveyors 12, 13 carry groups 9'. When the consuming machines 17, 29 operate normally, the majority of sheets which are delivered to the conveyor 7 are admitted into the magazines 17A, 29A and the surplus goes into the machine 6 and/or into the stacker 32.

An important advantage of the improved apparatus is that facilities (auxiliary conveyors 15, 27) for temporary storage of groups 9′ of sheets S are provided immediately ahead of each consuming machine so that a consuming machine whose magazine is empty or about to become empty can receive an adequate supply of sheets even if, at such time, the transporting system F is incapable of diverting sheets into the respective consuming machine. Thus, the feeding conveyors and the magazines of the consuming machines can receive sheets without any or with a negligible delay when their level detectors indicate the need for introduction of fresh sheets while the adjacent sections of the transporting system F do not carry sheets and/or the adjacent switches cannot divert sheets onto the respective feeding conveyors because such switches are in the process of guiding groups of sheets from the preceding to the next-following sections or conveyors of the transporting system. It often suffices to employ relatively short auxiliary conveyors, i.e., conveyors which need not be capable of storing an entire group 9′, as long as the number of sheets on an auxiliary conveyor suffices to satisfy the requirements of the associated consuming machine until such time when the feeding conveyor of such consuming machine can receive sheets directly from the main path which is defined by the transporting system F. As shown in FIG. 1, each auxiliary conveyor is located between two switches including an upstream switch (10 or 21) which can divert sheets onto the respective auxiliary conveyor and a downstream switch (13 or 24) which can divert sheets from the main path into the corresponding magazine (17A or 29A) when the auxiliary conveyor does not support a group of sheets.

The illustrated apparatus can be modified in a number of ways without departing from the spirit of the invention. Thus, and as already mentioned above, some or all of the conveyors can be dimensioned to support two or more discrete groups 9′. Furthermore, the conveyor 8, 20 and/or 26 can be replaced with two or more shorter conveyors and a switch can be provided between each pair of neighboring shorter conveyors to divert, when necessary, groups of sheets S into one or more additional consuming machines and/or into one or more surplus receiving units (such as the machine 6 and/or the stacker 32). In other words, the number of consuming machines can be increased to three or more and the number of surplus receiving units can be reduced to one (as mentioned above, the stacker 32 is optional if the apparatus includes the row forming machine 6, or vice versa) or increased to three or more.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. Apparatus for intermittently delivering sheets to at least one consuming machine, comprising transporting means defining a predetermined path for advancement of successive sheets, particularly a series of groups of sheets, said transporting means including a preceding and a next-following sheet advancing section each having a sheet-discharging end and a third section located upstream of said preceding section, as considered in the direction of advancement of sheets along said path; a first switch provided at the discharging end of said next-following section; means for moving said switch to and from a position in which said switch diverts sheets from said path into said consuming machine; means for temporary storage of sheets adjacent to said consuming machine; a second switch disposed between said preceding and next-following sections; means for moving said second switch between a first position in which said second switch guides sheets from said preceding section into said next-following section and a second position in which said second switch diverts sheets leaving said preceding section into said storage means; means for receiving sheets from said path; a third switch between said third and preceding sections; and means for moving said third switch between first and second positions in which said third switch respectively guides sheets toward said preceding section and diverts sheets to said receiving means.

2. Apparatus for intermittently delivering sheets to a plurality of consuming machines including a first machine and a second machine, comprising transporting means defining a predetermined path for advancement of successive sheets, particularly a series of groups of sheets, said transporting means including a preceding, a next-following, a third and a fourth sheet advancing section each having a sheet-discharging end, said third and fourth sections being respectively located downstream of said next-following section and said third section and said second machine being located downstream of said first machine, as considered in the direction of advancement of sheets along said path; a first switch provided at the discharging end of said next-following section; means for moving said switch between a first position in which said switch diverts sheets from said path into said consuming machine and a second position in which said switch guides sheets from said next-following section into said third section; means for temporary storage of sheets adjacent to said first consuming machine; a second switch disposed between said preceding and next-following sections; means for moving said second switch betweeen a first position in which said second switch guides sheets from said preceding section into said next-following section and a second position in which said second switch diverts sheets leaving said preceding section into said storage means; a third switch at the discharging end of said fourth section; means for moving said third switch to and from a position in which said third switch diverts sheets from said path into said second consuming machine; second means for temporary storage of sheets adjacent to said second machine; a fourth switch between said third and fourth sections; and means for moving said fourth switch between first and second positions in which said fourth switch respectively guides sheets from said third into said fourth section and directs sheets into said second storage means.

3. Apparatus as defined in claim 2, wherein said storage means comprises an auxiliary conveyor and further comprising means for driving said conveyor in a direction to transfer sheets from said conveyor into said first consuming machine.

4. Apparatus as defined in claim 2, wherein said second storage means comprises an auxiliary conveyor and further comprising means for driving said conveyor in a direction to transfer sheets from said conveyor into said second consuming machine.

5. Apparatus as defined in claim 2, wherein said consuming machines are gathering machines.

6. Apparatus as defined in claim 2, wherein each of said third and fourth sections comprises at least one conveyor and each of said conveyors has a length which suffices to accept at least one group of sheets.

7. Apparatus as defined in claim 2, wherein said transporting means has a discharge end and further comprising means for receiving the sheets which reach said discharge end of said transporting means.

8. Apparatus as defined in claim 7, wherein said receiving means includes a stacker.

9. Apparatus as defined in claim 2, further comprising means for receiving the surplus of sheets from said path, an additional switch provided in said transporting means ahead of said preceding section, as considered in the direction of movement of sheets along said path, and means for moving said additional switch between first and second positions in which said additional switch respectively guides sheets toward said preceding section and diverts sheets into said receiving means.

10. Apparatus as defined in claim 2, wherein the requirements of said consuming machine at least temporarily exceed the maximum rate of transport of sheets along said path.

11. Apparatus as defined in claim 10, wherein the capacity of said first consuming machine is variable.

12. Apparatus as defined in claim 2, wherein said transporting means further comprises a fifth section upstream of said preceding section, and further comprising means for receiving sheets from said path, a fifth switch between said fifth and preceding section, and means for moving said fifth switch between first and second positions in which said fifth switch respectively guides sheets toward said preceding section and diverts sheets to said receiving means.

13. Apparatus for intermittently delivering sheets to at least one consuming machine, comprising transporting means defining a predetermined path for advancement of successive sheets, particularly a series of groups of sheets, said transporting means including a preceding and a next-following sheet advancing section each having a sheet-discharging end; a first switch provided at the discharging end of said next-following section; means for moving said switch to and from a position in which said switch diverts sheets from said path into said consuming machine; means for temporary storage of sheets adjacent to said consuming machine; a second switch disposed between said preceding and next-following sections; means for moving said second switch between a first position in which said second switch guides sheets from said preceding section into said next-following section and a second position in which said second switch diverts sheets leaving said preceding section into said storage means; means for receiving the surplus of sheets from said path; an additional switch provided in said transporting means ahead of said preceding section, as considered in the direction of movement of sheets along said path; and means for moving said additional switch between first and second positions in which said additional switch respectively guides sheets toward said preceding station and diverts sheets into said receiving means.

14. Apparatus as defined in claim 13, wherein said receiving means comprises means for assembling sheets into rows.

* * * * *